US008621805B2

(12) United States Patent
McClure

(10) Patent No.: US 8,621,805 B2
(45) Date of Patent: Jan. 7, 2014

(54) BRIDGING THERMAL BLOCK SYSTEM AND METHOD

(75) Inventor: Richard R. McClure, Basehor, KS (US)

(73) Assignee: BlueScope Buildings North America, Inc., Kansas City, MO (US)

( * ) Notice: Subject to any disclaimer, the term of this patent is extended or adjusted under 35 U.S.C. 154(b) by 0 days.

(21) Appl. No.: 13/296,994

(22) Filed: Nov. 15, 2011

(65) Prior Publication Data

US 2012/0255252 A1 Oct. 11, 2012

Related U.S. Application Data

(60) Provisional application No. 61/472,397, filed on Apr. 6, 2011.

(51) Int. Cl.
*E04B 1/74* (2006.01)

(52) U.S. Cl.
USPC ..... 52/404.1; 52/404.3; 52/410; 52/483.1

(58) Field of Classification Search
USPC ..... 52/404.1, 404.3, 407.3, 408, 410, 478, 52/483.1, 749.12
See application file for complete search history.

(56) References Cited

U.S. PATENT DOCUMENTS

| | | | | |
|---|---|---|---|---|
| 3,513,614 | A * | 5/1970 | Studzinski | 52/742.12 |
| 3,662,509 | A * | 5/1972 | Studzinski | 52/404.1 |
| 3,914,916 | A | 10/1975 | Simpson et al. | |
| 4,047,346 | A * | 9/1977 | Alderman | 52/407.4 |
| 4,058,949 | A * | 11/1977 | Bellem | 52/407.1 |
| 4,075,806 | A | 2/1978 | Alderman | |
| 4,081,938 | A | 4/1978 | Bertacchi et al. | |
| 4,329,823 | A | 5/1982 | Simpson | |
| 4,346,543 | A * | 8/1982 | Wilson et al. | 52/404.2 |
| 4,361,993 | A | 12/1982 | Simpson | |
| 4,375,741 | A * | 3/1983 | Paliwoda | 52/127.1 |
| 4,379,381 | A * | 4/1983 | Holcombe | 52/404.3 |
| 4,446,665 | A | 5/1984 | Berger | |
| 4,528,789 | A | 7/1985 | Simpson | |

(Continued)

FOREIGN PATENT DOCUMENTS

| | | | |
|---|---|---|---|
| JP | 2000186388 | A | 7/2000 |
| JP | 2009221721 | A | 10/2009 |
| WO | 9512724 | A1 | 5/1995 |

OTHER PUBLICATIONS

International Search Report and Written Opinion issued in related PCT Patent Application PCT/US2011/060814, issued Apr. 10, 2012, 9 pages.

*Primary Examiner* — James Buckle, Jr.
(74) *Attorney, Agent, or Firm* — Lathrop & Gage LLP

(57) ABSTRACT

A system and method for insulating a metal roof include a blanket of insulation laid over at least one purlin. A series of thermal blocks are fastened above the purlin over the blanket of insulation. Each thermal block in the series of thermal blocks has legs that pin the blanket of insulation to a top of each purlin. Gaps are defined between the legs, the gaps enabling regions between the legs wherein the blanket of insulation is only partially compressed between the purlin and an underside of each thermal block. Each thermal block can include a first end, a second end, and a first leg between the first and second ends. The first end includes slots for receiving clip legs of a first roof clip. The second end includes an abutment surface and a landing surface for receiving a next thermal block in a series of thermal blocks.

8 Claims, 5 Drawing Sheets

(56) References Cited

U.S. PATENT DOCUMENTS

| | | | | |
|---|---|---|---|---|
| 4,557,092 | A | 12/1985 | Brueske | |
| 4,566,239 | A | 1/1986 | Smigel | |
| 4,571,909 | A | 2/1986 | Berghuis | |
| 4,642,961 | A | 2/1987 | Cruise | |
| 4,651,489 | A | 3/1987 | Hodges et al. | |
| 4,651,493 | A | 3/1987 | Carey | |
| 4,873,808 | A | 10/1989 | Heisey, Jr. et al. | |
| 5,406,764 | A | 4/1995 | Van Auken et al. | |
| 5,551,203 | A * | 9/1996 | Alderman et al. | 52/746.11 |
| 5,724,780 | A | 3/1998 | Bolich | |
| 6,694,693 | B2 | 2/2004 | Alderman | |

* cited by examiner

BRIDGING THERMAL BLOCK SYSTEM AND METHOD

CROSS-REFERENCE TO RELATED APPLICATIONS

This application claims the benefit of U.S. Provisional Application No. 61/472,397, filed Apr. 6, 2011, the disclosure of which is incorporated herein by reference.

BACKGROUND OF THE INVENTION

1. Field of the Invention

The invention relates generally to the field of roof structures and related methods. More specifically, the invention relates to the field of insulating metal roofing structures.

2. Description of the Related Art

Roof insulation has been used in metal building arrangements. A typical roof insulation configuration uses blanket insulation. The thermal resistance offered by the insulation is compromised when it is compressed or packed down. In conventional metal roof insulation systems, when the roof structure is applied to the tops of the roof purlins, the thick layer of blanket insulation is compressed, thus reducing the thermal resistance of the roof insulation system. In some areas of the conventional roof system, the compression of the insulation is so severe that a thermal short is created, thus substantially degrading the insulation properties of the roof insulation system.

SUMMARY

According to a first aspect, the present disclosure provides a thermal block for a metal roof, the thermal block comprising a first end, a second end, and a first leg between the first and second ends. The first end includes slots for receiving clip legs of a first roof clip. The second end includes an abutment surface and a landing surface for receiving a next thermal block in a series of thermal blocks.

According to another aspect, the present disclosure provides a system comprising a blanket of insulation laid over at least one purlin. A series of thermal blocks are fastened above the purlin over the blanket of insulation. Each thermal block in the series of thermal blocks has legs that pin the blanket of insulation to a top of each purlin. Gaps are defined between the legs, the gaps enabling regions between the legs wherein the blanket of insulation is only partially compressed between the purlin and an underside of each thermal block.

According to another aspect, the present disclosure provides a method of providing insulation in a metal roof, the method comprising: laying a blanket of insulation over at least one purlin; fastening a series of thermal blocks above the purlin over the blanket of insulation, each thermal block in the series of thermal blocks having legs that pin the blanket of insulation to a top of each purlin; and forming gaps between the legs, the gaps enabling regions between the legs such that the blanket of insulation is only partially compressed between the purlin and an underside of each thermal block.

BRIEF DESCRIPTION OF THE DRAWINGS

The foregoing and other features and advantages will be apparent from the more particular description of preferred embodiments, as illustrated in the accompanying drawings, in which like reference characters refer to the same parts throughout the different views. The drawings are not necessarily to scale; the sizes of elements may be exaggerated for clarity.

DETAILED DESCRIPTION

Embodiments of the present invention provide systems and methods for providing insulation for a metal roof.

Figure 1:
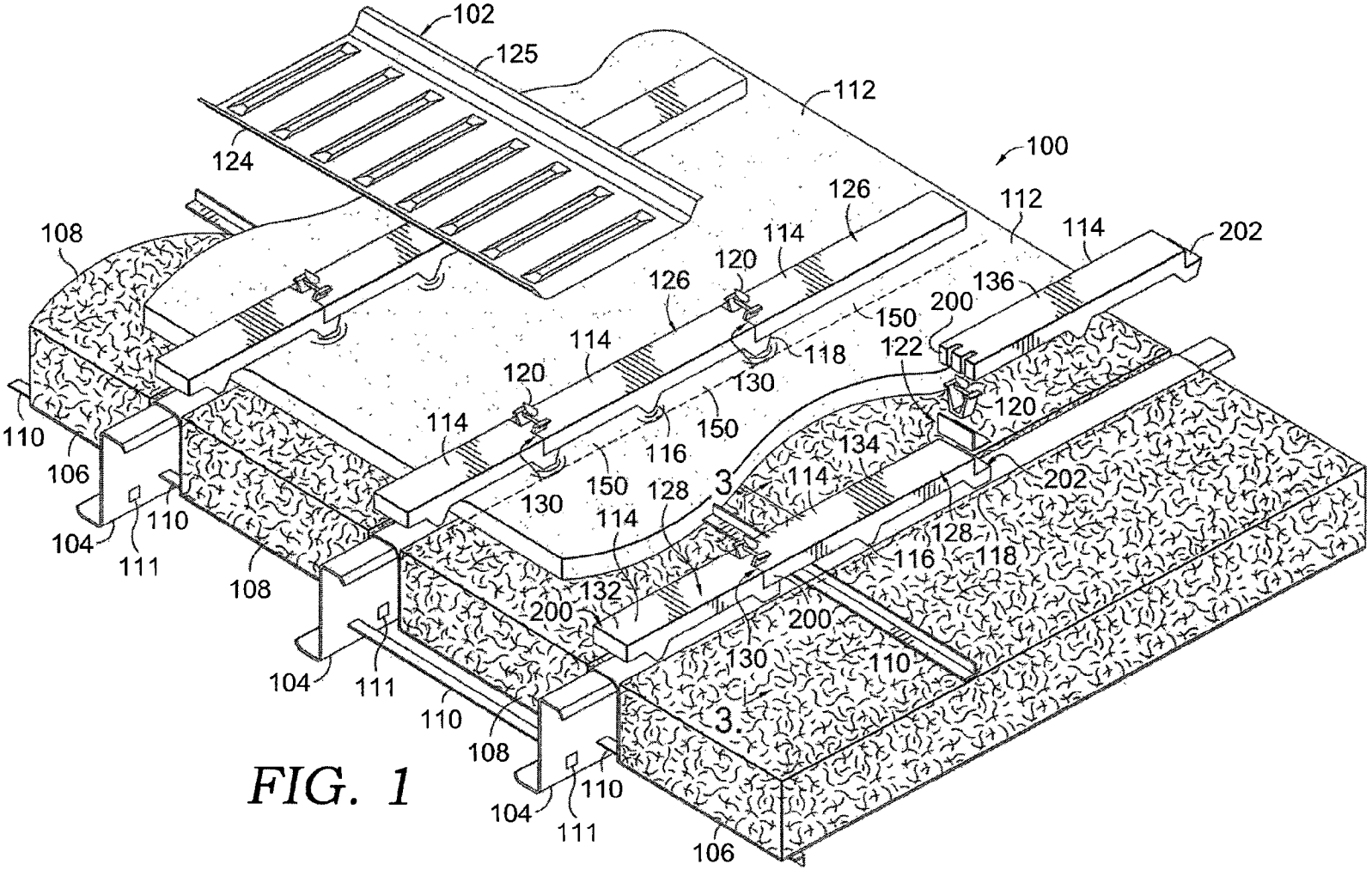
FIG. 1 contains a schematic perspective view of an overall system as utilized in a roof structure, according to an embodiment.

One embodiment is depicted in FIGS. 1, 2A-E, and 3. Referring first to FIG. 1, a broken out portion of a roof incorporating an embodiment of the system is illustrated in perspective. The system 100 is provided to support and insulate roof panels 102 which will be installed on top of the assembly. The system rests on top of a plurality of Z-purlins 104. Although only three Z-purlins are shown in FIG. 1, it should be understood that many more of these purlins in parallel relation would be included on various roof structures on a building.

Figure 3:
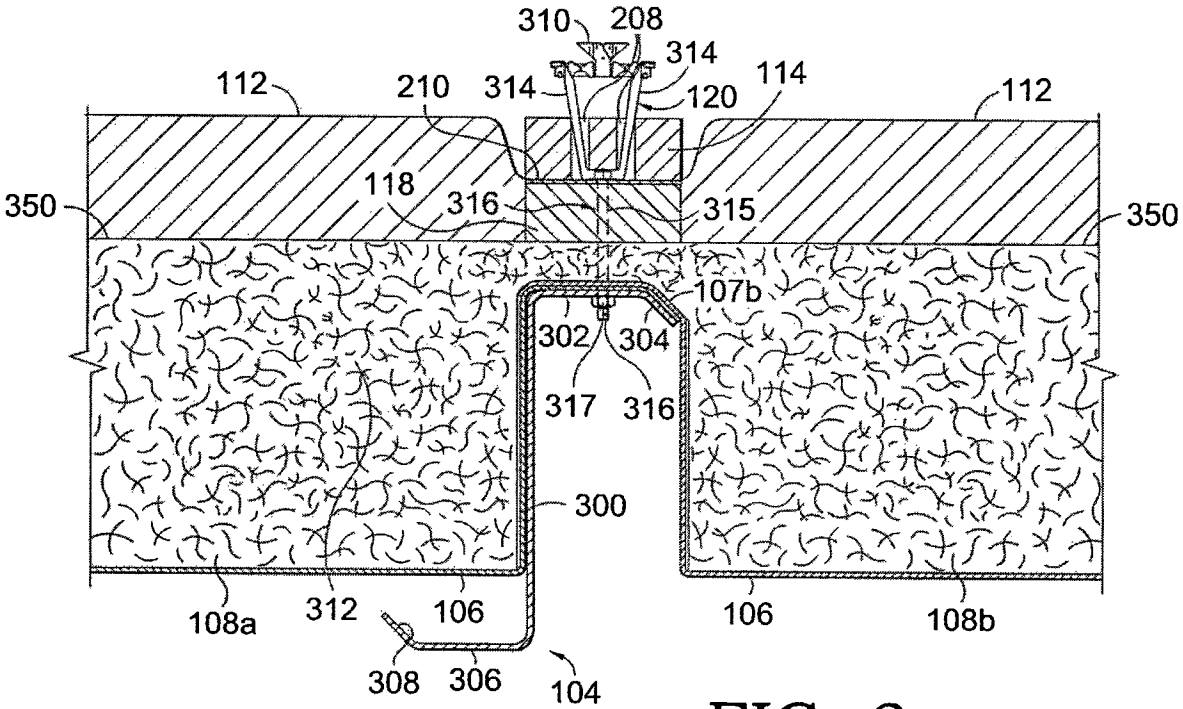
FIG. 3 contains a schematic cross-sectional view taken at a purlin showing the bridging thermal blocks, insulation, and other roof structures at the section 3-3 taken from FIG. 1.

In cross-section, the Z-Purlins typically have a vertical web portion 300 (see FIG. 3) and horizontal top flange 302 and bottom flange 306 portions. The horizontal top flange 302 has a downwardly sloped front lip 304. The bottom flange portion 306 of purlin 104 has an upwardly angled lip 308, and the bottom 306 extends in an opposite direction than does the top flange portion 302. Although the system can be used with different kinds of purlins (e.g., C-shaped and other varieties), the purlins 104 shown in FIGS. 1 and 3 are Z-shaped, and are, therefore, referred to as Z-purlins. The roof frame also includes a plurality of angle-metal cross members 110 which are installed in an offset staggered fashion through alternating opposed sets of apertures 111 in the webs 300 of the purlins 104 in a known manner.

Initially, two opposing strips of batt insulation 108*a* and 108*b*, each having laterally extending flaps 107*a* and 107*b* on each side, are unrolled over and rest on top of the cross members 110 in the space existing between the opposing purlins. Then, extended portions 107*a* and 107*b* are draped over each on top of the upper flange 302 of the purlin as can be seen in FIG. 3. The opposing batts of insulation 108*a* and 108*b* each run between and in the direction of the purlins 104 as shown in the figures. Insulation 108, in embodiments, is a fiberglass insulation (often marketed in rolls) which is commonly used to insulate floors, walls and ceilings. This insulation typically comes with a vapor barrier sheet already installed on the underside of the roll. The laterally extending flaps are a deviation from the norm, but are a feature easily included by the manufacturer. Although most commonly made of fiberglass, insulation 108 could also be constructed of other insulating materials.

When these strips of insulation 108 are unrolled in place between the purlins, the insulation is not compacted in any way, allowing it to maintain full thermodynamic properties. And this freedom from encumbrance will be maintained in the final product.

Once the insulation strips 108 have been unrolled in the space between the purlins, and the flaps 107*a* and 107*b* have been draped over the purlin upper flange, a blanket of insulation 112 is laid into place over the purlins (as seen in FIG. 1). This insulation, in embodiments, is constructed of fiberglass, but could be made from any number of materials depending on the application. This blanket 112 is held down by the bridging blocks 114.

Each series of bridging blocks 114 is installed such that it runs longitudinally along the upper portions 302 of each Z-purlin 102 as shown in FIG. 1. The bridging blocks have a number of features, the details of which can be seen in FIGS. 2A-E in which a single block is shown.

Figure 2A:
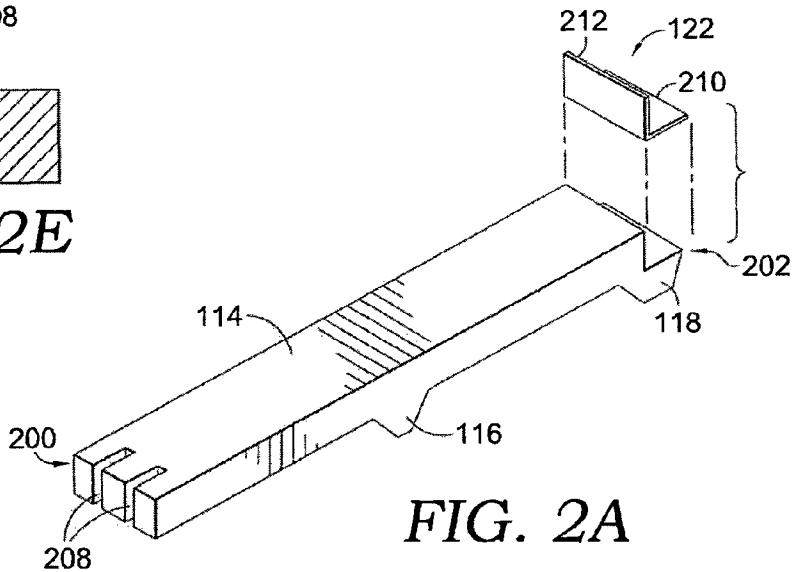
FIGS. 2A-E contain schematic views illustrating the bridging blocks used in the system and method in the disclosed embodiment.
Figure 2B:
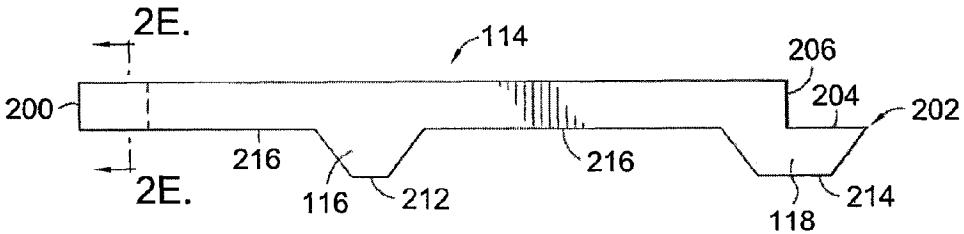
Figure 2E:
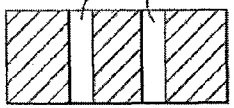
Figure 2C:
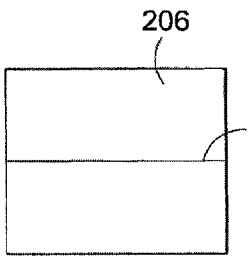
Figure 2D:
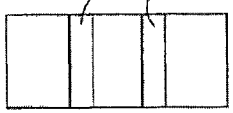

As seen in FIGS. 2A and 2B, each bridging block 114 includes an intermediate leg 116 and a joint supporting leg 118. A first end 200 of each block includes two clip-leg-receiving notched out vertical slots 208. These slots 208 can be seen most clearly in the end view (FIG. 2D) of the first end 200, and in the Section 2E-2E shown in FIG. 2E. These slots 208 are designed to receive legs 314 (see FIG. 3) at each of the joints 130 (see FIG. 1) to avoid clip/block interference.

A second end 202 of each bridging block (see FIGS. 2A, 2B, and 2C) includes a landing surface 204 as well as an abutment surface 206 for receiving the corresponding first end 200 of the next block in the series. But before the first end 200 for the next block in the series is received, an L-bracket 122 is installed. A short portion 212 of the L-bracket 122 is sized to fit the abutment surface 206, and the longer portion 210 of the L-bracket 122 is sized to match the landing surface 204. These end configurations, along with the clips 120 and L-brackets 122 enable the installation of a series of continuous blocks in series one after the other, and each block 114, in the disclosed embodiment, is identical. Alternatively, these blocks could have different configurations for different embodiments.

Referring to FIG. 1, a first series 126 of blocks 114 have already been installed, whereas a second series 128 of bridging blocks 114 are in the process of being installed. The blocks 114 in series 126 and 128 in FIG. 1 come together at joints 130. The joints 130 are formed by the meeting of the second end 202 of an already installed block, e.g. block 132, and the first end 202 of the next block, e.g., block 134, in the series to be installed. Block 132 (FIG. 1) has already been fastened to the purlin 104, and block 134 is shown about to be fastened at its end 202 using L-bracket 122 and clip 120.

The L-bracket 122, when installed, will clamp down on the landing surface 204 at end 202 when the particular clip 120 at that joint 130 is screwed down using two fasteners 316. One of these fasteners 316 can be seen in FIG. 3. Although only one fastener of the pair 316 can be seen in FIG. 3, it should be understood that two exist and that the second is simply hidden behind the first. These fasteners could be a bolt 315/nut 317 combination as shown, or alternatively can be screws. Although a bolt arrangement is shown, screws are preferred. Prefabricated, e.g., punched or drilled, holes (not shown) can exist in the bottom of the clip 120 in one embodiment. The fasteners 316 are installed through these holes, then through predrilled or prepunched holes (not shown) made through the landing portion 210 of the L-bracket 122, then through predrilled or prepunched holes (not shown) made through the joint support leg 118 of the block 114, through the insulation blanket 112 and the flaps 107*a* and 107*b*, and then through predrilled or prepunched holes made into the purlin head 302. See FIG. 3. In any instance, predrilling will not be required through the 107*a* and 107*b* or the blanket of insulation 112, because both are easily pierced by the fastener 316. Where screws are used, the predrilled or prepunched holes are optional. Additionally, where predrilled holes or prepunched are used in the purlin head 302, they will be sized to be slightly smaller than the diameter of the screws to encourage engagement into the head 302.

Regardless of the fastening device used (bolt or screw), the fastening causes the L-bracket 122 to clamp down on the landing area 204 of block 134, and not only is second end 202 of block 134 held down, but the first end of that same block 134 is thus caused to rest into its joint with the already installed block 132.

Now that the second end 202 of block 134 has been secured by the clip and L-bracket installed there, the clip legs 208 and seam flanges 310 will stick up and are exposed. Then, in order to install the next block 136, the slots 208 of its first end 200 are matched up with and consume the clip legs 314 of the clip already installed on the last block 134. Then, when the clip 120 and L-bracket 122 are screwed down onto the landing area 204 of block 136, the joint between blocks 134 and 136 is complete. It will be understood that block after block can be installed in series this way until the entire length of a purlin 104 is reached.

As the blocks in each series are secured, the flaps 107*a* and 107*b* and a small swatch of the insulation blanket 112 are pinched between the underside of each block 114 and the purlin head 302. More specifically, the bottom surfaces 212 and 214 of each of the legs 116 and 118 on each block, respectively, directly clamp down on the blanket 112 and flaps 107*a* and 107*b*.

Gaps 150 (see series 126 in FIG. 1) formed by underside surfaces 216 between the legs 116 and 118 on each bridging block, however, allow for some expansion of the insulation in that area. Thus, although somewhat restricted in volume, the insulation blanket between the block legs still has some depth, and is not completely compacted. This provides heat transfer resistance advantages. Laterally relative to each row of blocks 114, the blanket expands upward back to its normal density and fills the area above the upper surfaces 350 of the lower insulation strips 108 to be at the same levels as the upper surfaces of the installed blocks 114.

Next, the metal roof panels 102 are installed over and transversely to the blocks. More specifically, the flanges 310 on top of the clips 120 are seamed into edges 124 and 125 of the roof panels 102 in a known manner. Although only a single roof panel is shown in FIG. 1, those skilled in the art will be aware that a plurality of roof panels will be installed such that the entire roof is covered.

Figure 4:
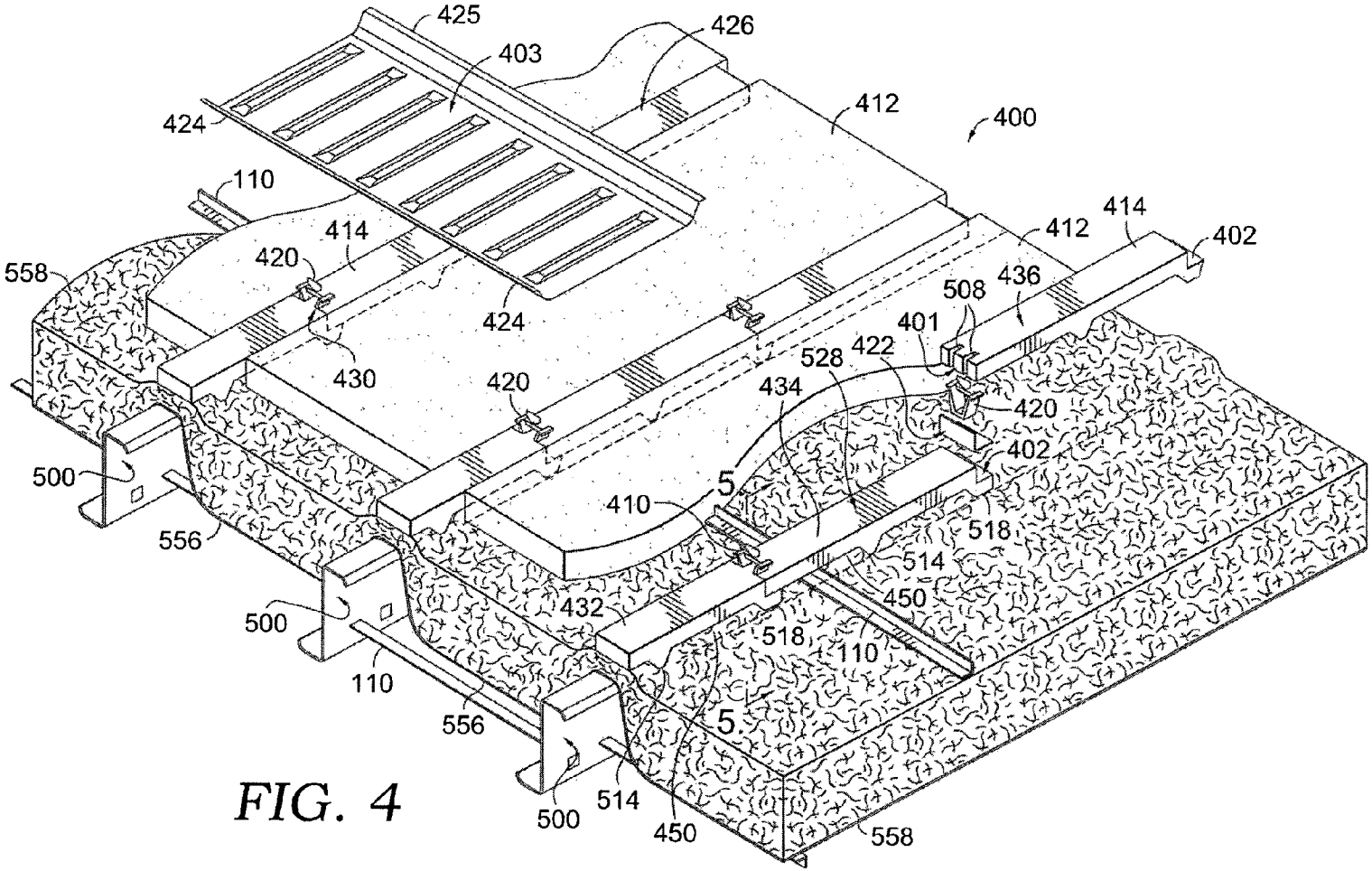
FIG. 4 contains a schematic perspective view of an overall system as utilized in a roof structure, according to an embodiment.
Figure 5:
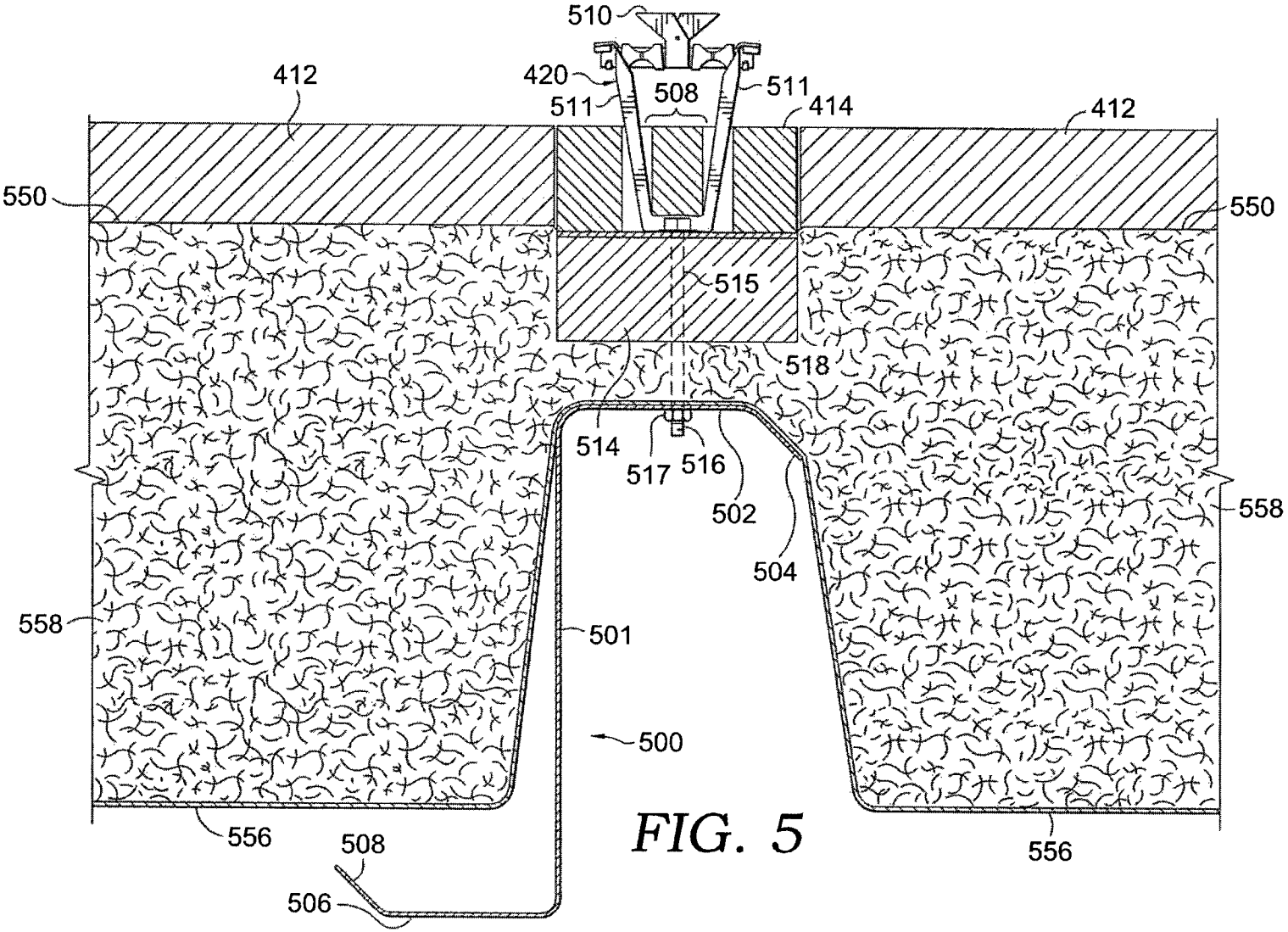
FIG. 5 contains a schematic cross-sectional view taken at a purlin showing the bridging thermal blocks, insulation layers, and other roof structures at the section 5-5 taken from FIG. 4.

Another embodiment is depicted in FIGS. 4-5. The embodiment of FIGS. 4-5 uses the same bridging block configuration shown in FIGS. 2A-E, so detailed description of this element of the disclosed roof system has not been repeated. Referring first to FIG. 4, a broken out portion of a roof incorporating this second embodiment is illustrated. Again, the system 400 is provided to support and insulate roof panels 403 which will be installed on top of the assembly. Again, the system rests on top of the plurality of Z-purlins 500. Although only three Z-purlins 500 are shown in FIG. 4, it should be understood that many more of these purlins 500 in parallel relation would be included on the entire roof structure. FIG. 5 shows the system 400 of the second embodiment in cross-section. The Z-Purlin 500 has a vertical web portion 501 (see FIG. 5) and horizontal top portion 502 and a bottom portion 506. The horizontal top portion 502 has a downwardly sloped front lip 504. The bottom portion 506 of purlin 500 has a lip 508, and the bottom 506 extends in an opposite direction from the direction of the top portion 502. Although the second embodiment 400 of the system can be used with different kinds of purlins (e.g., C-shaped and other varieties), the purlin cross sections shown in FIGS. 4 and 5 are Z-shaped. As with the last embodiment, the roof frame will also include a plurality of angle-metal cross members 110 which are installed through apertures in the webs 501 in the purlins 500 in a known manner.

Initially, a blanket of insulation 558 is laid out over the purlins 500 such that it sags down to rest atop the cross members 110. This is different than with the first embodiment which had thin batts 108 which were unrolled and extended longitudinally between the opposing purlins 104. Here instead, the blanket is draped over all. Insulation blanket 558, in the embodiments of FIGS. 4 and 5, is a fiberglass insulation (often marketed in rolls) which includes a vapor barrier sheet 556 on its bottom side. Although most commonly made of fiberglass, blanket 558 could be constructed of other materials. Further, vapor-barrier sheet 556 and blanket 558 could be separate components, the blanket laid on top of the sheet.

Once blanket 558 has been laid into place over the purlins 500, the bridging blocks 414 are installed directly on top of the upper portion 302 of each Z-purlin 500 as shown in FIG. 4.

Referring to FIG. 4, a first series 426 of blocks 414 have already been installed, whereas a second series 528 of bridging blocks 414 are in the process of being installed. The blocks 414 in series 426 and 528 shown in FIG. 4 come together at joints 430. The joints 430 are formed by the meeting of the second end 402 of an already installed block, e.g. block 432, and the first end 401 of the next block, e.g., block 434, in the series to be installed. Block 432 (FIG. 4) has already been fastened to the purlin 500, and block 434 is shown about to be fastened at its end 402 using L-bracket 422 and clip 420.

Here however, since the blanket 558 of insulation is already draped across the purlin heads, the L-brackets 422, when installed, will clamp the leg bottoms of the bridging blocks 414 down on top of a small patch of insulation on the purlin heads.

Prefabricated/drilled holes (not shown) exist in the bottom of the clip 420 in the preferred second embodiment. A bolt 515 nut 517 combination (see FIG. 5), or a screw could be used to fasten. The fasteners 516 are installed through these holes, then through the larger portion of the L-bracket 422 (see, e.g., portion 210 in FIG. 2), then through the joint support leg 518 of the block 414, and then into the purlin 500. See FIG. 5.

Two holes (not shown) can be predrilled or prepunched down through the landing portion (see e.g. 210 in FIG. 2) of the L-bracket 422, predrilled or prepunched bores made through the leg 518 of the bridging block 414, then through the thin layer of blanket insulation which has been compressed below the leg 518, and then down to predrilled or prepunched holes on the purlin head 502. With the bolt version the bolts have lengths which cause the bolt tips to drop through the leg 518, through the insulation, and then drop underneath the purlin head 502 (see FIG. 5) where the nut 517 can be screwed on. Where the fastening mechanisms 516 are self-drilling screws they will be passed down and then secured through the holes in the upper surface 502 of the Z-purlin 500 below which when screws are used, will have diameters slightly smaller than the screws selected so that they can bite. This causes the L-bracket 422 to clamp down on the landing area (e.g., see area 204 in FIG. 2B) of block 414.

Now that the second end 402 of block 434 has been secured by the clip 420 and L-bracket 422 installed there, the clip legs 511 and seam flanges 510 will stick up and are exposed. Then, in order to install the next block 436, the slots 508 of its first end 401 are matched up with and consume the clip legs 511 of the clip already installed on the last block 434. Then, when the clip 402 and L-bracket 422 are screwed down onto the landing area of block 436, the joint between blocks 434 and 436 is complete. It will be understood that block after block can be installed in series this way until the entire length of a purlin 500 is reached.

As the blocks in each series are secured, the lower batt insulation sheet 558 and vapor barrier 556 are pinched between the underside of each block 414 and the purlin upper flange 502. More specifically, the bottom surfaces (e.g., bottom surfaces 212 and 214 in FIG. 2) of each of the legs 514 and 518 on each block, respectively, directly pinch the insulation blanket 558 to the upper surface of each purlin head 502. In gaps 450 (see series 426 in FIG. 4) formed between the legs 514 and 518 on each block, however, the insulation, although somewhat restricted in volume, is partially puffed out. This provides heat transfer resistance advantages. The upper surface of the insulation 550 (see FIG. 5), other than where it is pinched underneath the legs 514 and 518, is substantially maintained at a level equal to the surfaces underneath the blocks 414.

Once all of the blocks 414 have been secured, a relatively thin strip of batt insulation 412 is unrolled into the rectangular cavities formed between the opposing series of blocks, e.g., between series 426 and 528 where the insulation extends longitudinally, as shown in FIG. 4. Board insulation could be used instead of batt insulation in embodiments. The upper insulation layer 412, if made from board insulation, will be precut to fit the cavities. Where rolls of batt insulation are used, they are normally sized in width to fit between standard purlin spacing. There, the upper insulation layer 412 sits on top of the upper surface 550 of the lower blanket and fills the open area between the rows of blocks above the lower blanket 558, as shown in FIG. 4.

Once the relatively thin strips of batt insulation 412 are laid in place, the metal roof panels 403 are installed over and transversely to the blocks 414. More specifically, the flanges 510 on top of the clips 420 are seamed into edges 424 and 425 of the roof panels 403 in a known manner. Although only a single roof panel is shown in FIG. 4, those skilled in the art will be aware that a plurality of roof panels will be installed such that the entire roof is covered.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A thermal block system for a metal roof, the thermal block comprising:

a first end with at least one slot disposed therein;

a second end;

a first leg between the first and second ends;

an abutment surface and a landing surface at the second end for receiving a next thermal block in a series of thermal blocks, the first end of the next thermal block engaging at least one of the abutment surface and the landing surface when the thermal block and the next thermal block are connected; and a clip with at least one clip leg inserted into at least one slot disposed within the first end, wherein the clip secures together the thermal block and the next thermal block in the series of thermal blocks.

2. The thermal block system of claim 1, wherein a second leg is disposed beneath the landing surface.

3. A system, comprising:

a blanket of insulation laid over at least one purlin; and a series of thermal blocks fastened above the purlin over the blanket of insulation, wherein each thermal block in the series of thermal blocks comprises:

a plurality of integral support legs protruding from a bottom surface of the thermal block, each of the support legs engaging a first portion of the blanket of insulation and capturing the first portion of the blanket of insulation between the support leg and the purlin and compressing the first portion of the blanket of insulation between the support leg and the purlin a first compression amount; and at least one gap defined at the bottom surface of the thermal block between the support legs, a second portion of the blanket of insulation being disposed between the bottom surface of the thermal block and the purlin and being compressed between the bottom surface of the thermal block and the purlin a second compression amount less than the first compression amount.

4. The system of claim 3, wherein the blanket of insulation is above a relatively thicker strip of insulation, the relatively thicker strip existing in a pocket created between an opposing set of purlins.

5. The system of claim 3, wherein the blanket of insulation is below a relatively thinner strip of insulation, the relatively thinner strip of insulation filling a space located between two opposing rows of thermal blocks.

6. A method of providing insulation in a metal roof, the method comprising:

laying a blanket of insulation over at least one purlin; and fastening a series of thermal blocks above the purlin over the blanket of insulation, each thermal block in the series of thermal blocks comprising a plurality of integral support legs protruding from a bottom surface of the thermal block and at least one gap defined at the bottom surface of the thermal block between the support legs, such that, when the series of thermal blocks is fastened above the purlin and over the blanket of insulation, each of the support legs engages a first portion of the blanket of insulation and captures the first portion of the blanket of insulation between the support leg and the purlin and compresses the first portion of the blanket of insulation between the support leg and the purlin a first compression amount, and a second portion of the blanket of insulation disposed between the bottom surface of the thermal block and the purlin is compressed between the bottom surface of the thermal block and the purlin a second compression amount less than the first compression amount.

7. The method of claim 6, wherein the blanket of insulation is above a relatively thicker strip of insulation, the relatively thicker strip existing in a pocket created between an opposing set of purlins.

8. The system of claim 6, wherein the blanket of insulation is below a relatively thinner strip of insulation, the relatively thinner strip of insulation fining a space located between two opposing rows of thermal blocks.

* * * * *